United States Patent [19]

Saijo

[11] Patent Number: 4,820,179

[45] Date of Patent: Apr. 11, 1989

[54] MULTI-CONTACT ELECTRICAL CONNECTOR

[75] Inventor: Yoshihiro Saijo, Osaka, Japan

[73] Assignee: Nippon Acchakutanshi Seizo Kabushiki kaisha, Osaka, Japan

[21] Appl. No.: 528,147

[22] Filed: Aug. 31, 1983

[30] Foreign Application Priority Data

Aug. 31, 1982 [JP] Japan ..... 57-152389

[51] Int. Cl.[4] ..... H01R 13/41; H01R 13/11; H01R 4/24

[52] U.S. Cl. ..... 439/224; 439/397; 439/680; 439/682; 439/692; 439/733; 439/834; 439/861; 439/873

[58] Field of Search ..... 339/17 LC, 95 R, 103 M, 339/258 R, 258 P, 96, 97 R, 97 P, 98, 99 R, 103 R, 65, 66 R, 66 M, 184 R, 184 M, 186 R, 186 M, 223 R, 116 R, 116 C

[56] References Cited

U.S. PATENT DOCUMENTS

| | | | |
|---|---|---|---|
| 3,202,959 | 8/1965 | Keller | 339/258 R X |
| 3,543,223 | 11/1970 | Krautwald et al. | 339/258 R X |
| 4,255,009 | 3/1981 | Clark | 339/97 P |
| 4,277,124 | 7/1981 | Loose et al. | 339/223 R X |
| 4,346,955 | 8/1982 | Chesnais et al. | 339/97 R |
| 4,365,857 | 12/1982 | Watanabe et al. | 339/186 M X |

FOREIGN PATENT DOCUMENTS

| | | | |
|---|---|---|---|
| 2201883 | 7/1973 | Fed. Rep. of Germany | 339/258 R |

*Primary Examiner*—John McQuade
*Assistant Examiner*—Steven C. Bishop
*Attorney, Agent, or Firm*—Antonelli, Terry & Wands

[57] ABSTRACT

A multi-contact electrical connector for electrically connecting a plurality of wires to a printed circuit board. The electrical connector includes an open topped housing having a plurality of contact chambers, wire holding sections, and terminal receiving bores, with the terminal receiving bores intersecting lower portions of the contact chambers and extending in parallel to the wire holding sections. Each wire holding section includes a securing arrangement such that the wire placed therein is securely held, and each of the contact chambers accommodates a contact member having a pair of spaced pressing elements, with a space between the pressing elements being narrower than a diameter of a conductor in the wires so that the insulating cladding or cover of the wire is penetrated by side ridges of the pressing elements to allow the conductor of the wire to make an electrical contact with the contact member. The contact member also includes an arrangment which enables the terminal inserted in the terminal receiving bore to be detachably held so as to ensure an electrical connection therebetween.

13 Claims, 4 Drawing Sheets

MULTI-CONTACT ELECTRICAL CONNECTOR

The present invention relates to an electrical connector and, more particularly, to a multi-contact electrical connector adapted to electrically connect a plurality of wires to a printed circuit board through a plurality of post-type terminals mounted thereon.

The various sizes of electrical connectors used depend, to a great extent, on the size and nature of the equipment in which the connectors are employed. Since electrical appliances and electrical equipment are becomming smaller and lighter in weight, there is a strong industrial demand for providing the smallest possible electrical connectors which nevertheless ensure the existence of a realiable electrical connection.

The present invention seeks to meet the demand in the industry and to provide an improved multi-contact electrical connector by which the realiability of the connector is ensured even with minimized or relatively small sized multi-contact electrical connectors.

More particularly, the aim underlying the present invention essentially resides in providing a multi-contact connector capable of electrically connecting a plurality of insulation clad wires to a printed circuit board by terminals mounted thereon through an insulator, wherein the connector is of a compact size, and wherein the wires are connected to the terminals securely so as to prevent a withdrawal of the wires by detrimental external forces such as, for example, a torsion force and/or a pulling force.

In accordance with advantageous features of the present invention, a multi-contact electrical connector is provided which includes an open-topped housing having a plurality of contact chambers, wire holding sections, and terminal receiving bores. The terminal receiving bores intersect a lower portion of the contact chambers and extend in parallel with the wire holding sections, with each of the wire holding sections including means for securing holding a wire placed therein. Each contact chamber is adapted to receive a contact member, with each contact member including contact body having a pair of spaced pressing or urging means, with a space between the pressing means being narrower or smaller than a diameter of a conductor in the wire whereby the insulating clading or cover is broken or penetrated by side ridges of the pressing means to thereby allow the conductor in the wire to come into full electrical contact with the contact member. The contact member also includes means for enabling a terminal inserted in the terminal receiving bore to be detachably held to thereby ensure an electrical connection therebetween.

Advantageously, in accordance with the present invention, the contact member is formed as a one piece structure, preferably, stamped from a sheet of electrically conductive material which is subsequently folded or bent to a predetermined shape.

According to still further features of the present invention, the pair of spaced pressing or urging means provided in the contact member are advantageously formed by opposing side walls of the body of the contact member, with the body having a substantially box-shaped configuration.

The means for enabling a holding of the terminal in the terminal receiving bore of the housing may, in accordance with the present invention, be fashioned or formed by extending portions of the substantially box-shaped contact body, with terminating ends thereof being rolled so as to impart a springing force thereto.

In accordance with yet further features of the present invention, the electrical connector includes an insulator base located at a position intermediate to the housing and the printed circuit board, with the insulator base including means for allowing or permitting the post-terminals mounted on the printed circuit board to pass therethrough. An upstanding back wall is provided on the insulator base, with the back wall being disposed in parallel to the post-type terminals received in the insulator base. Advantageously, the back wall is provided with projections engageable with wire holding means in the wire holding sections thereby covering and protecting the wire holding sections against contamination and external impurities such as, for example, water, dirt, or the like.

Accordingly, it is an object of the present invention to provide a multi-contact electrical connector for allowing an electrical connection between a plurality of wires and a printed circuit board which avoids, by simple means, shortcomings and disadvantages encountered in the prior art.

Another object of the present invention resides in providing a multi-contact electrical connector for allowing an electrical connection between a plurality of wires and a printed circuit board which achieves a firm electrical connection even with a minimal or relatively small size connector and which prevents any possible deterimental external forces such as, for example, torsion, from adversely acting on the electrical connector.

Another object of the present invention resides in providing a multi-contact electrical connector by which it is possible to employ an electrical contact member of a one-piece construction stamped from a sheet of metal thereby enabling the manufacturing of relatively inexpensive connectors.

Yet another object of the present invention resides in providing a multi-contact electrical connector for allowing an electrical connection between a plurality of wires and a printed circuit board which protects wire holding sections of the connector from intrusion by contaminates and/or external impurities.

A still further object of the present invention resides in providing a multi-contact electrical connector for allowing an electrical connection between a plurality of wires in a printed circuit board which ensures the existence of a realiable electrical connection regardless of the disposition or orientation of the electrical connector.

Another object of the present invention is to provide a multi-contact electrical connector for allowing an electrical connection between a plurality of wires and a printed circuit board which is simple in construction and therefore relatively inexpensive to manufacture.

These and other objects, features, and advantages of the present invention will become more apparent from the following description when taken in connection with the accompanying drawings which show, for the purposes of illustration only, one embodiment in accordance with the present invention, and wherein.

Figure 1:
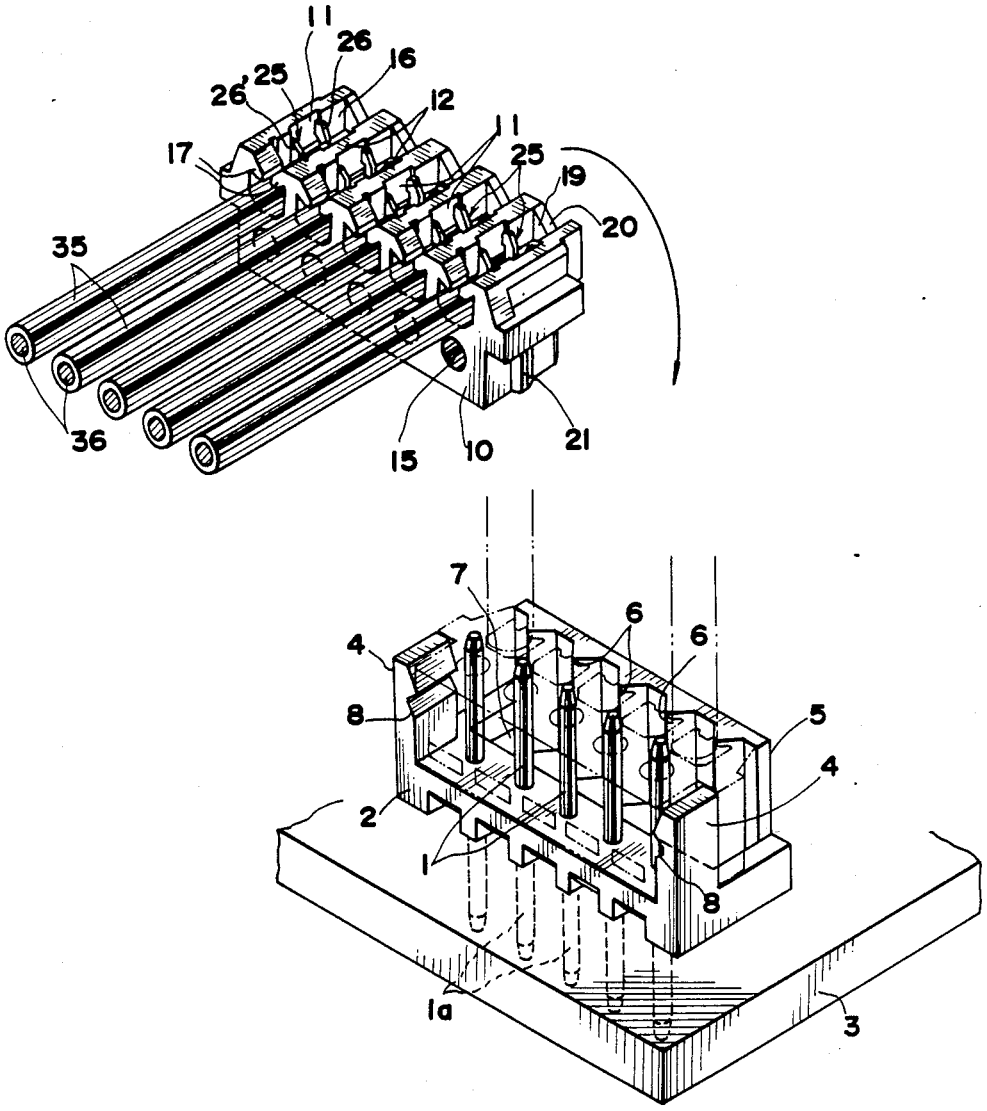
FIG. 1 is an exploded perspective view of a disassembled multi-contact electrical connector constructed in accordance with the present invention having a housing including contacts and insulation clad wires and a printed circuit board having post-type terminals mounted thereon.
Figure 8:
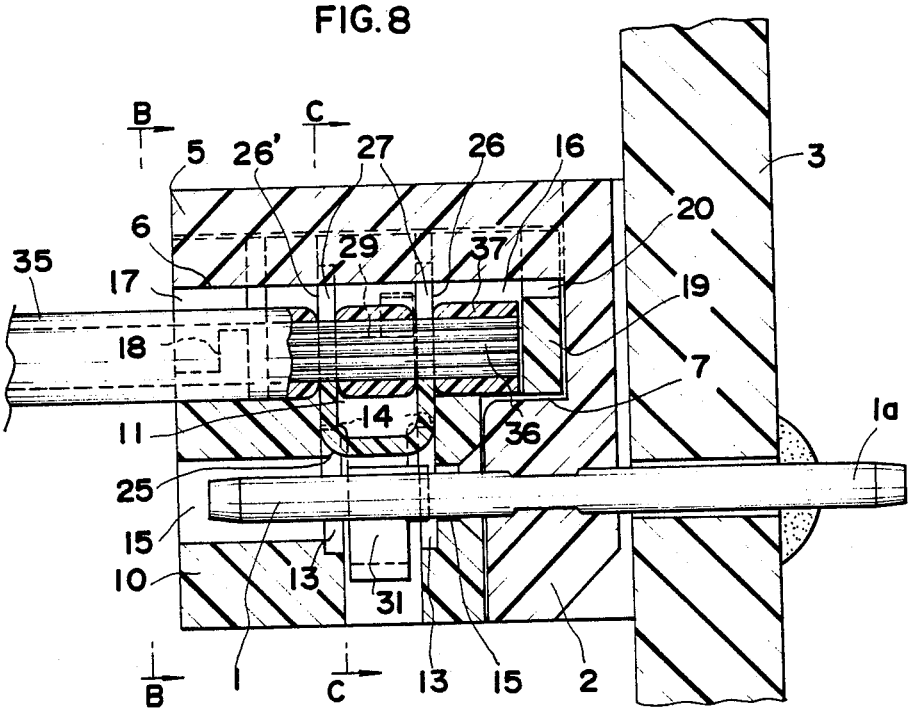
FIG. 8 is a cross sectional view illustrating an assembled state of the housing and printed circuit board with a multi-contact electrical connector constructed in accordance with the present invention.
Figure 9:
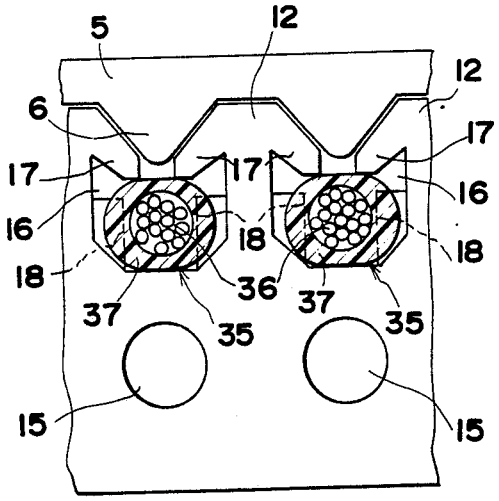
FIG. 9 is a cross sectional view taken along the line B—B in FIG. 8.

Referring now to the drawings wherein like reference numerals are used throughout the various views to designate like parts and, more particularly, to FIG. 1, according to this Figure, a multi-contact electrical connector for electrically connecting a plurality of wires to a printed circuit board includes a plurality of post-type terminals 1, of an electrically conductive material extending through an insulator base 2, with the respective terminals 1 being mutually spaced from one another and anchored in apertures (not shown) provided in a printed circuit board 3 so that a tip 1*a* of each terminal 1 is soldered to the printed circuit board 3 at a back side thereof in a manner more clearly illustrated in FIG. 8.

The insulator base 2, forming a terminal section, is provided at both lateral sides thereof with upright supporting arms 4, with the supporting arms 4 being constructed so as to support a housing 10 forming a contact section of the electrical connector. Each supporting arm 4 is provided with a slot 8 and a back wall 5 at a rear thereof, with the back wall 5 being adapted to cover an open top surface of the housing 10 when the housing is coupled or connected to the insulator base 2. The back wall 5 is provided, on an inner surface thereof, with a plurality of projections 6 corresponding to the number of terminals 1. The individual projections 6, the function of which will be described more fully hereinbelow, are spaced from and face the respective terminals 1, with each projection 6 having a triangular cross sectional configuration. A recess 7 is provided between the back wall 5 and the terminals 1, with the recess 7 being adapted to accommodate rear walls 19 of the housing 10 so as to thereby secure a firm coupling or connection between the housing 10 and the insulator base 2.

The housing 10 is fashioned or formed of an insulating material such as, for example, nylon or the like, and is provided with a plurality of chambers 11, with each of the chambers 11 being adapted to respectively accommodate individual contacts generally designated by the reference numeral 25. Each of the chambers 11 is open at the respective ends thereof, that is, each chamber 11 has neither a ceiling or top portion nor a bottom portion. The respective chambers 11 are separated from each other by partitions or wall members 12 and, as shown in FIG. 3, each of the partitions 12 include ribs 13 at lower four corners thereof, with each of the ribs 13 including a shoulder portion 14 adapted to support the contact 25 inserted in the chamber 11 so as to prevent the respective contacts 25 from being displaced downwardly from the associated chamber 11.

Figure 2:
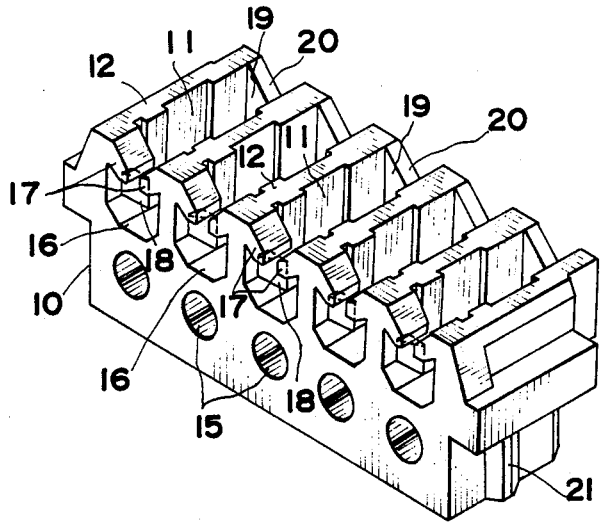
FIG. 2 is a perspective view of a housing body of the multi-contact electrical connector constructed in accordance with the present invention.
Figure 3:
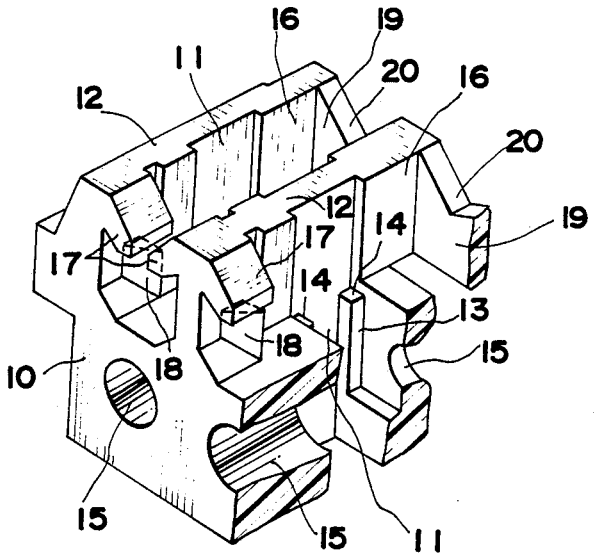
FIG. 3 is a cross sectional perspective view of a portion of the housing body of FIG. 2.

As also shown most clearly in FIG. 3, the housing 10 is provided with a plurality of bores or openings 15 which extend transversely to a longitudinal center axis of the housing 1 and intersect the chambers 11 at midpoints thereof. An open space 16 extends laterally across the housing 10, with each open space 16 being adapted to accommodate an insulation clad wire 35 which is pressed therein. As shown in FIGS. 2 and 3, the respective open spaces 16 extend in parallel to the respective bores or openings 15, with each open space 16 being provided with a pair of spaced opposed pawls 17 which protrude or extend from the opposing partitions 12. A projection 18 is provided which functions as a fixing means whereby an inserted wire 35 is secured at the entrance of the respective open spaces 16. The pawls 17 and projections 18 both ensure a firm connection between the wire 35 inserted into the open space and the contact 25 accommodated in the chamber 11. A rear end of the respective open spaces 16 is defined by a rear wall 19, with the rear wall 19 including a V-shaped recess 20. An angle of the V-shaped recess corresponds to an angle formed by the opposing pawls 17, with the V-shaped recess 20 being adapted to accommodate the projections 6 of the back wall 5 of the housing 10 when the housing 10 and insulator base 2 are assembled in the manner indicated by the arrow in FIG. 1. At this stage of the assembly, the projections 6 are also supported, at the end portions opposite the V-shaped recesses 20, in the recesses formed by the spaced opposed pawls 17. A tenon 21 (FIG. 2), provided at each side of the housing 10, is adapted to fit into the respective slots 8 of the supporting arms 4 of the base 2. When the housing 10 and base 2 are assembled, the respective tenons 21 are engaged in the slots 8 of the supporting arms 4 thereby strengthening the coupling or connection between the housing 10 and the insulating base 2.

Figure 5:
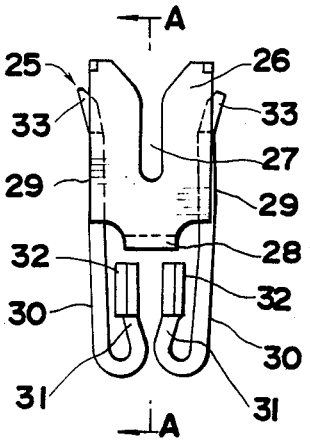
FIG. 5 is a front view of the contact member of FIG. 4.
Figure 4:
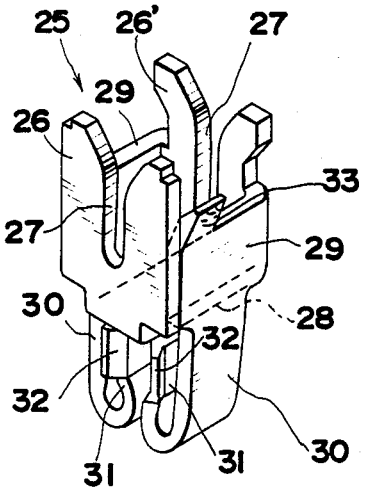
FIG. 4 is a perspective view of a contact member of the multi-contact electrical connector of the present invention.
Figure 6:
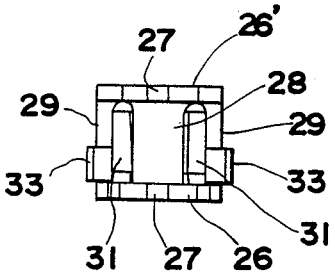
FIG. 6 is a top plan view of the contact member of FIG. 4.
Figure 7:
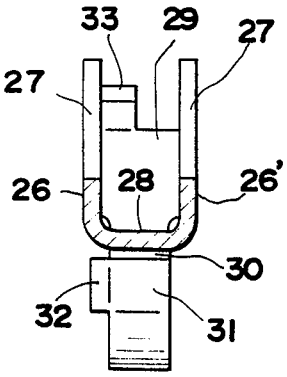
FIG. 7 is a cross-sectional view taken along the line A—A in FIG. 5.

As shown most clearly in FIGS. 4–7, each contact 25 includes a contact body which is stamped out from the metal sheet of an electrically conductive material, with the relatively small metal sheet being bent or folded into a predetermined form. Each contact body includes a pair of spaced pressing or urging tongues 26, 26′, with each tongue 26, 26′ including a substantially V-shaped slot 27 adapted to tightly receive the wire 35. The tongues 26, 26′ are spaced from each other at a distance such that the slot 27 is narrower or smaller than a diameter of the conductor 36 of the wire 35. As shown in FIG. 5, the pressing tongues 26, 26′ are connected, at a bottom end thereof, by a connecting member 28. The contact body is substantially box-shaped and is defined by the pair of pressing tongues 26, 26′, a pair of side walls 29 and the connecting member 28, with the pair of pressing tongues 26, 26′ also forming the side walls 29 of the contact body. Each side wall 29 includes an extension portion 30 having a terminating end 31 which is inwardly rolled so as to impart a springing or biasing force thereto. A guide member 32 is secured to the rolled terminating end 31, with the guide member 32 being adapted to guide the post-type terminal 1 as the terminal 1 is inserted between the two opposed rolled ends 31 when the hosing 10 and the insulator base 2 are assembled. The side walls 29 are provided with pawls 33 adapted to receive the respective contacts 25 in the respective chambers 11.

Figure 10:
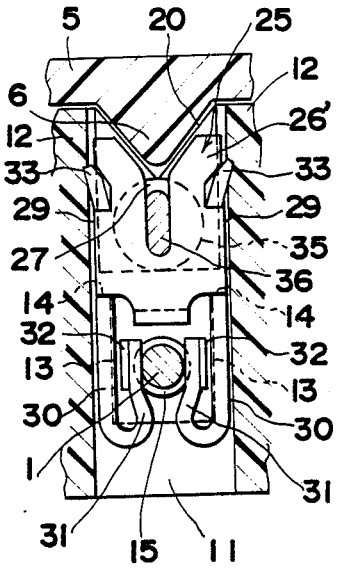
FIG. 10 is a cross sectional view taken along the line C—C in FIG. 8.

As shown in FIGS. 8 and 10, each contact 25 is accommodated in a chamber 11, with the pressing tongues 26, 26' being located in the open space 16, and with the rolled terminating ends 31 being located in the bore 15. As evident from FIG. 4, the side wall 29 is wider than the extending portion 30 with shoulders being interposed therebetween. The shoulders are adapted to abut the shoulders 14 provided in the chamber 11 thereby preventing the contact 25 from moving downwardly or slipping out. Additionally, the pawls 33 of the contact 25 are engaged or caught in the inside wall of the chamber 11 thereby securing the contact 25 in the chamber 11.

In this manner, a required number of contacts may be loaded in the individual chambers 11 and then wires 35 pressed into the contacts 25 through the open spaces 16 until the electrical and mechanical connection or coupling is secured therebetween. The electrical and mechanical connection or coupling is achieved by forcing the respective insulation clad wires 35 into the slots 27 of the pressing tongues 26, 26', which, as noted above, has a width smaller or narrower than a diameter of the conductor 36, whereby side ridges of the slots 27 penetrate through the outer insulating clading or cover 37 until the side ridges come into contact with the conductor 36. Thus, with the multi-contact electrical connector of the present invention no special skill nor tools are required to effect the connection or coupling between the wire 35 and the contacts 25. At this stage of the assembly, the wire 35 is pressed in between the opposing pawls 17, and the projections 18 also penetrate through the outer insulating clading or cover 37 in which they are caught thereby ensuring that the wire 35 is held against a possible pulling force and/or a torsion exerted on the wire 35.

The housing 10, loaded with the wires 35, is united or joined with the printed circuit board 3 through the insulator base 2, wherein, as noted above, the post-type terminals 1 mounted on the printed circuit board 3 are inserted into the bores 15 of the housing as shown in phantom lines in FIG. 1. As shown in FIG. 10, the post-type terminals 1 inserted into the bores 15, are held between the rolled ends 31 at which the post-type terminal 1 comes into contact with the contact 25 by which the electrical connection or coupling is secured between the post-type terminal 1 and the conductor 36. In this manner, the post-type terminal 1 and the wire 35 are arranged in parallel or in a parallel-line relationship thereby ensuring that no large space is required for accommodating the assembled electrical connector. When the housing 10 and the insulator base 2 are assembled, the tenons 21 on the housing 10 are engaged in the slots 8 on the insulator base 2 thereby securing the firm connection or coupling of the housing 10 to the insulator base 2. The back wall functions as a cover for covering the open top surface of the housing 10 thereby protecting the contacts 25 loaded therein against outside impurities or contaminates, such as, for example, water, dirt, or the like. At the same time, the projections 6 on the back wall 5 extend transversely or cross wise in the open spaces 16 and exert pressure on the opposed pawls 17 as shown most clearly in FIG. 10. Consequently, the wires 25 are securely held between the housing 10 and the insulator base 2. Even when the wires 35 undergo or are subjected to a detrimental external force such as a torsion or pulling force, the connection or coupling between the wires 35 and the contacts 25 is safely maintained.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A multi-contact electrical connector for connecting a plurality of insulation clad wires to a circuit means, the electrical connector comprising:

a plurality of electrical contact means adapted to be respectively connected to the insulation clad wires, each of the electrical contact means are fashioned as a stamped one piece sheet metal member bent into a predetermined shape and includes a substantially box shaped contact body and a pair of spaced pressing means provided with opposed side ridges, with the space between the pressing means being less than a diameter of a conductor in the wires whereby the insulation cladding of the wires is penetrated by the side ridges to enable a contact between the electrical contact means and the conductor, said pressing means being formed by opposed side walls of said contact body;

a housing means including a plurality of chamber means for respectively accommodating the electrical contact means, means for holding the respective wires in the housing means, and means adapted to receive electrical terminal means connected to the circuit means, the means for receiving being arranged in a lower portion of the respective chamber means and extending substantially parallel to the means for holding the respective wires; and means provided on each of said electrical contact means for establishing a detachable electrical connection between the electrical contact means and the terminal means including an extension portion provided on at least two opposed side walls of said contact body, said extension portions terminating in rolled ends so as to impart a biasing force thereto.

2. A multi-contact electrical connector according to claim 1, further comprising an insulator means interposed between said housing means and said circuit means, said insulator means including means for accommodating the terminal means, a wall means disposed substantially parallel to the terminal means for covering and protecting the means for holding the respective wires from intrusion by contaminants, and means engageable with the means for holding the respective wires for ensuring a secure holding of the wires between the insulator means and the housing means.

3. A multi-contact electrical connector according to claim 2, wherein said means for ensuring a secure holding of the wires between the insulator means and the housing means includes a plurality of spaced projections provided on the wall means and adapted to be disposed in opposition to the terminal means.

4. A multi-contact electrical connector according to claim 3, wherein said housing means is open at a top and bottom end thereof, and wherein said wall means extends over the top end of the housing means.

5. A multi-contact electrical connector according to claim 4, wherein said circuit means is a printed circuit board.

6. A multi-contact electrical connector according to claim 1, wherein each of the means adapted to receive the terminal means includes a bore extending through a lower portion of the respective chamber means, partition means are provided for separating the respective chamber means from each other, and means are provided on each of said partition means for supporting the electrical contact means in the respective chamber means.

7. A multi-contact electrical connector according to claim 6, wherein said means for supporting the electrical contact means includes a rib means provided on each of said partition means in a lower portion thereof for limiting an insertion depth of the electrical contact means into the respective chamber means, each of said rib means being provided with a shoulder portion adapted to engage the electrical contact means.

8. A multi-contact electrical connector according to claim 1, wherein said means for holding the respective wires in said housing means includes a pair of spaced opposed pawl means associated with each of the chamber means for engaging the respective wires, means are provided in said housing means for defining a plurality of spaces for accommodating the respective wires, each of said spaces extending substantially parallel to the means adapted to receive the electrical terminal means, and wherein means are provided in each of the spaces for ensuring a firm connection between the respective wires and the electrical contact means.

9. A multi-contact electrical connector according to claim 8, further comprising an insulator means interposed between said housing means and said circuit means including means for accommodating the terminal means, means disposed substantially in parallel with the terminal means for covering and protecting the means for holding the respective wires from intrusion by contaminants, and means engageable with said means for holding the respective wires for ensuring a secure holding of the wires between the insulator means and the housing means.

10. A multi-contact electrical connector according to claim 9, wherein said means for ensuring a secure holding of the wires between the insulator means and the housing means includes a plurality of spaced projections provided on the means for covering and protecting and extending in a direction substantially parallel to the terminal means, said means for defining a plurality of spaces includes a wall means disposed on a side of the housing means opposite said spaced opposed pawl means, and wherein means are provided in said wall means for accommodating said projections.

11. A multi-contact electrical connector according to claim 10, wherein said insulator means includes a pair of support means provided at opposite lateral sides thereof for supporting the housing means, and wherein means are provided in said support means and said housing means for connecting the same to each other.

12. A multi-contact electrical connector according to claim 8, wherein said circuit means is a printed circuit board.

13. A multi-contact electrical connector according to claim 8, wherein partition means are provided for separating the respective chamber means from each other, and wherein said pair of opposed pawl means are formed by projections provided on adjacent partition means.

* * * * *